United States Patent [19]

Leung

[11] Patent Number: 4,488,640

[45] Date of Patent: Dec. 18, 1984

[54] KIT FOR PRODUCING ANTISTATIC AND FABRIC SOFTENING ARTICLE

[75] Inventor: Yuen P. Leung, Montville, N.J.

[73] Assignee: Beecham Inc., Clifton, N.J.

[21] Appl. No.: 949,793

[22] Filed: Oct. 10, 1978

[51] Int. Cl.[3] ..... B05C 3/09; B65D 69/00

[52] U.S. Cl. ..... 206/229; 68/21; 68/22 R; 118/115; 118/121; 118/400; 206/205; 220/90; 427/242

[58] Field of Search ..... 118/400, 404, 121, 424, 118/427, 115; 206/205, 210, 568, 570, 229; 68/22 R, 21; 427/242, 369, 439, 443; 220/90

[56] References Cited

U.S. PATENT DOCUMENTS

| | | | |
|---|---|---|---|
| 273,233 | 2/1883 | Horner et al. | 427/369 X |
| 1,803,951 | 5/1931 | Thoma | 118/400 X |
| 3,634,947 | 1/1972 | Furgal | 427/242 X |
| 3,686,025 | 8/1972 | Morton | 427/242 X |

*Primary Examiner*—Evan K. Lawrence

*Attorney, Agent, or Firm*—Jacobs & Jacobs

[57] ABSTRACT

A kit is produced which comprises an active agent, such as a fabric softener and antistatic composition, a reusable substrate capable of being coated with or impregnated with the active agent and means for coating or impregnating said substrate both initially and for recoating or re-impregnating said substrate with the active agent after each use or after multiple uses.

1 Claim, 9 Drawing Figures

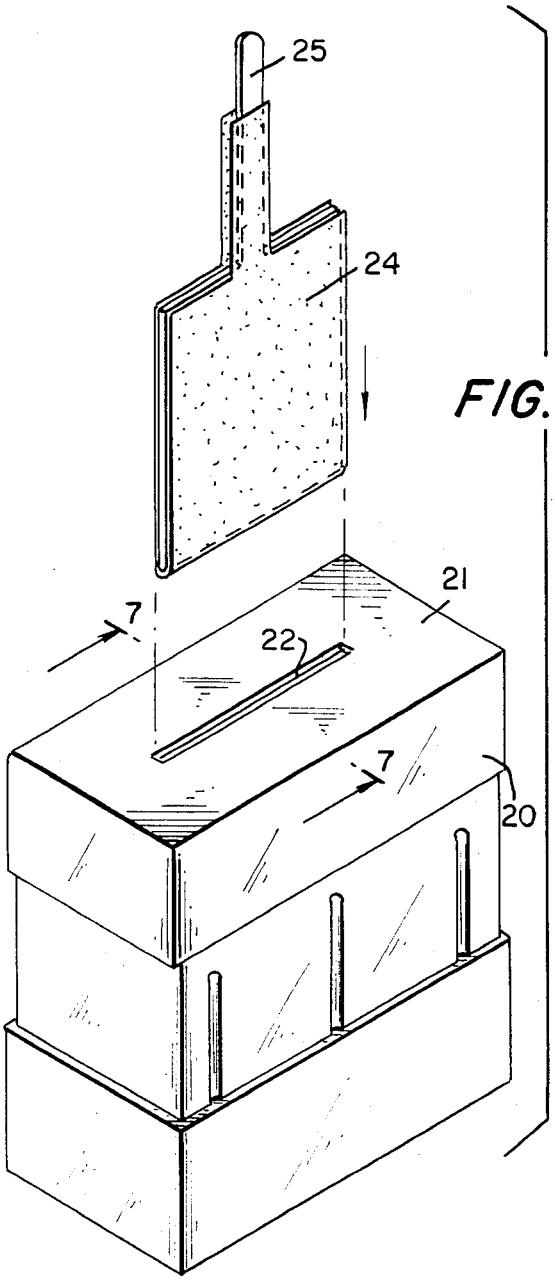
FIG.5
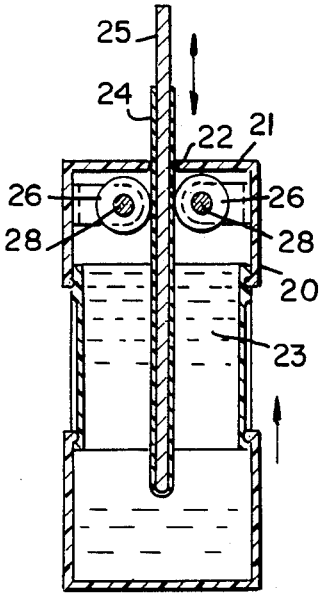
FIG. 7
FIG.8
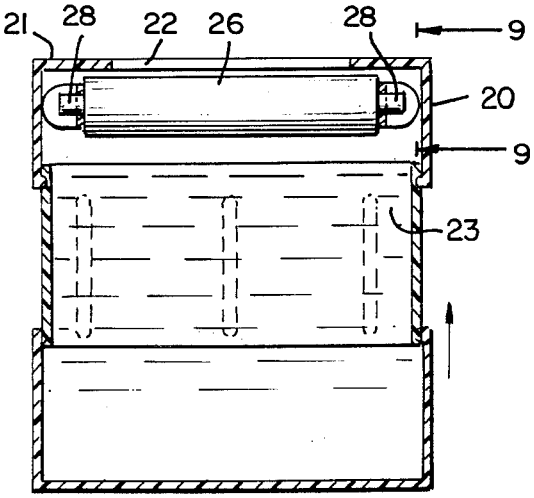
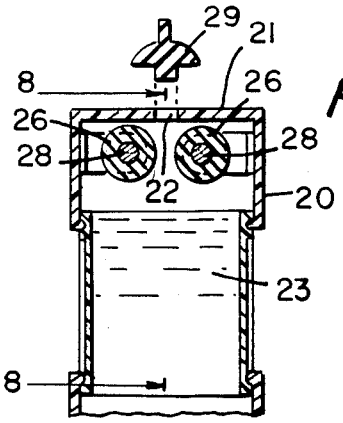
FIG. 6
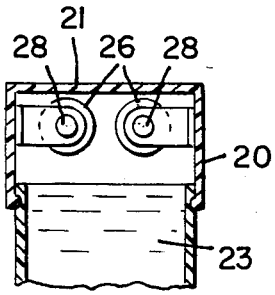
FIG. 9

KIT FOR PRODUCING ANTISTATIC AND FABRIC SOFTENING ARTICLE

The present invention is concerned with means for enabling one to obtain multiple uses from a single substrate.

One particularly valuable aspect of the present invention is the provision of a kit enabling one to obtain multiple uses from an antistatic fabric softening product which usage imparts antistatic and fabric softening properties to articles during the fabric drying cycle of an automatic dryer.

It is known in the art that fabrics may be commingled with compositions containing fabric softeners to provide a soft antistatic finish to the fabrics during the course of the drying operation. Various substrates are known to be coated with or impregnated with such compositions. These include polyurethane foam, paper, woven and nonwoven cloth substrates, and the like. Many fabric softening and antistatic compositions are also known in the art. These include fatty alkyl cationic fabric softeners such as those disclosed in U.S. Pat. No. 3,634,947, glycerides such as those disclosed in U.S. Pat. No. 3,785,973, combinations of cationics and sorbitan esters such as those described in U.S. Pat. No. 4,022,938, as well as fabric softeners in combination with fatty polyol esters.

According to the present invention, any satisfactory fabric softening and antistatic composition is suitable, as well as any substrate on which such a composition may be coated or impregnated. Alternatively, the compositions of the present invention may contain a bacteriostatic or antifungal agent.

According to the present invention, a kit is provided which comprises an active agent, a reusable substrate capable of being coated with or impregnated with the active agent, and means for coating or impregnating the substrate and after use, recoating or reimpregnating said substrate with the active agent for subsequent usage.

According to one embodiment of the present invention, a kit is provided which enables one to reuse substrates (which are provided with the kit) by recoating them or re-impregnating them with sufficient antistatic and fabric softening composition after one or two usages to enable them to impart again the properties to fabrics when commingled in an automatic dryer.

The present invention is more particularly illustrated by the accompanying drawings wherein FIGS. 1-9 illustrate various embodiments of the present invention;

FIG. 5 shows an alternative enclosure and substrate;

FIG. 6 is a view taken along lines 7—7 of FIG. 5;

FIG. 7 is a view taken along lines 7—7 of FIG. 5 showing a substrate in the composition within the enclosure;

FIG. 8 is a view taken along lines 8—8 of FIG. 6; and

FIG. 9 is a view taken along lines 9—9 of FIG. 8.

Figure 1:
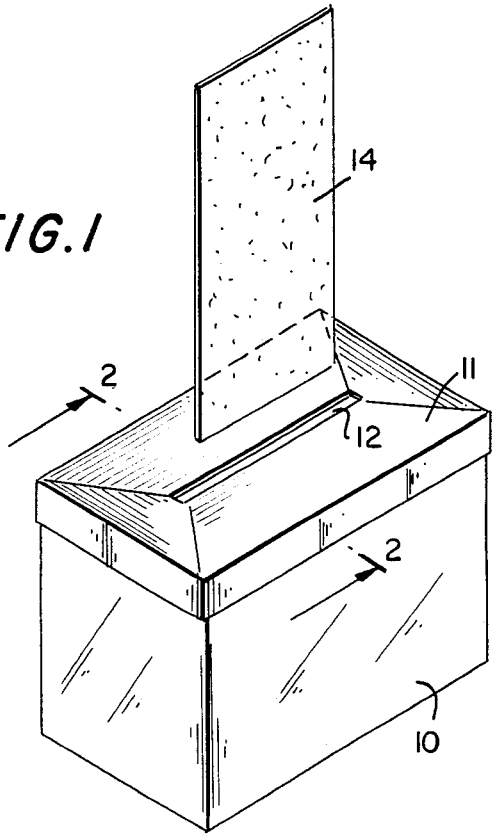
FIG. 1 shows an enclosure and substrate which are part of the kit according to the present invention.
Figure 2:
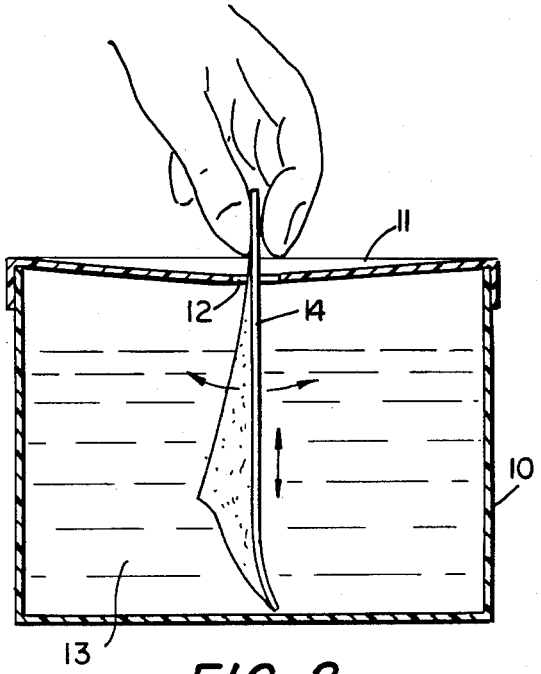
FIG. 2 is a view taken along lines 2—2 of FIG. 1.
Figure 3:
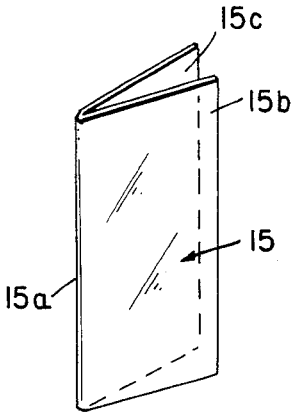
FIG. 3 shows one means for removing the excess composition from the substrate.
Figure 4:
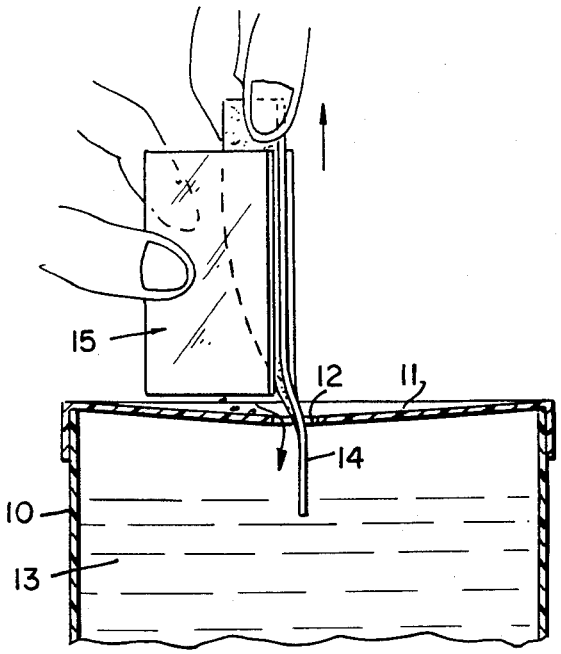
FIG. 4 shows the substrate coated or impregnated with the composition being removed from the enclosure and the excess composition being removed.

The present invention may be more fully understood by specific reference to the drawings. According to one embodiment of the present invention an enclosure 10 is provided having a top 11 through which there is a slot or orifice 12. Within the enclosure 10 is a composition having softness and antistatic properties 13. A suitable substrate 14 is pushed through orifice 12 into the interior of enclosure 10 so that it comes in full contact with composition 13 and is coated or impregnated with the composition. Thereafter, suitable means such as 15 having a flexible hinge **15*a* and substantially rigid faces 15*b* and 15c are placed around the substrate 14. Substrate 14 is removed from the enclosure by sliding it through means 15 as shown in FIG. 4, whereby the excess composition is removed from the substrate and runs back into the interior of enclosure 10. If desired, orifice 12** may have lips which are movable as the substrate passes therebetween but which provide a reasonable seal against accidental spillage.

According to an alternative embodiment of the present invention, there is provided an enclosure 20 having a top 21 in which is disposed an opening or orifice 22 which may be of the same general type as opening or orifice 12. Composition 13 is disposed within the enclosure and is shown as 23. A suitable substrate such as shown at 24 is folded around a rigid member 25 and is pushed through the orifice and passes between rollers 26 into the interior of the enclosure and comes in contact with composition 23 for the purpose of being coated or impregnated. Substrate 24 is coated or impregnated in a manner similar to substrate 14 and is then removed from enclosure 20 by pulling it upwards so that it passes first between rollers 26 and then out of opening or orifice 22. The rollers are rotatable about means 28.

If desired, the opening or orifice 22 may be more securely closed by a closure device 29 shown in FIG. 6. The present invention is particularly advantageous because it provides a kit which is readily usable by a housewife, whereby a suitable substrate may be coated or impregnated with a softening and antistatic composition which may then be placed in automatic dryer, used once or twice and the substrate then recoated or impregnated with the same composition and used again. It is envisioned that the kit of the present invention would comprise not only the enclosure and the softness and antistatic composition but a suitable supply of substrates.

Other and further uses for the invention will be more appreciated by those skilled in the art.

What is claimed:

1. A kit which is useful for producing an antistatic and fabric softening article which comprises an enclosure having an orifice through one surface within which enclosure is disposed a fabric softener and antistatic composition, said orifice being located above the level of the composition and sized such that a suitable length of substrate may be passed through the orifice into the interior of the enclosure in order to be contacted with said composition, a substrate which can be coated with or impregnated with said composition before initial use and which can be re-coated or re-impregnated after initial use, and a folded sheet of rigid material through which the substrate is passed as it is removed from the orifice to remove excess composition from such substrate after it has been coated or impregnated, initially or subsequently.

* * * * *